US007140221B2

(12) United States Patent
Shore

(10) Patent No.: US 7,140,221 B2
(45) Date of Patent: Nov. 28, 2006

(54) DIVIDE AND CHOP SHEAR ARRANGEMENT

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/106,344

(22) Filed: Apr. 14, 2005

(65) Prior Publication Data

US 2005/0235721 A1 Oct. 27, 2005

Related U.S. Application Data

(60) Provisional application No. 60/564,067, filed on Apr. 21, 2004.

(51) Int. Cl.
*B21B 39/18* (2006.01)

(52) U.S. Cl. ..... 72/203; 72/12.5

(58) Field of Classification Search ..... 72/8.8, 72/12.5, 203

See application file for complete search history.

(56) References Cited

U.S. PATENT DOCUMENTS 3,236,084 A 2/1966 Kato
3,251,212 A * 5/1966 Morgan ..... 72/203
3,258,951 A * 7/1966 Kinnicutt, Jr. et al. ..... 72/203
4,176,535 A 12/1979 Elsner et al.
4,250,729 A 2/1981 Berz
4,554,813 A 11/1985 Feldmann et al.
4,977,806 A 12/1990 Poloni
5,031,432 A 7/1991 Loesch et al.
5,040,440 A 8/1991 Harvey
5,307,663 A 5/1994 Shore et al.
5,517,887 A 5/1996 Danielsson

FOREIGN PATENT DOCUMENTS

DE 37 25 886 A1 9/1988

* cited by examiner

*Primary Examiner*—Lowell A. Larson
(74) *Attorney, Agent, or Firm*—Gauthier & Connors, LLP

(57) ABSTRACT

In a system for subdividing hot rolled product lengths being delivered from a rolling mill along a first path, a first switch acts in concert with a first shear to subdivide each product length traveling along the first path into successive segments including a front end segment, a plurality of intermediate segments, and a tail end segment, and to alternately deliver the successive segments to one or the other of two adjacent downstream second paths leading to a cooling bed. Second switches on the second paths are selectively adjustable between first positions allowing the intermediate segments to continue along the second paths, and second positions diverting the front and tail end segments from the second paths to third paths. A second shear chops the front and tail end segments moving along the third paths into scrap pieces.

6 Claims, 4 Drawing Sheets

DIVIDE AND CHOP SHEAR ARRANGEMENT

CROSS REFERENCE TO RELATED APPLICATION

This application claims priority from Provisional Patent Application Ser. No. 60/564,067 filed on Apr. 21, 2004.

BACKGROUND OF THE INVENTION

1. Field of the Invention

This invention relates generally to rolling mills producing hot rolled long products, e.g., bars, rods and the like, and is concerned in particular with the provision of an improved system for subdividing such products, with acceptable customer lengths being delivered to a cooling bed, and with unacceptable front and tail ends being diverted to a chopping shear.

2. Description of the Prior Art

Conventional systems of the above-mentioned type typically involve laterally diverting the hot rolled product from one path to another, usually by switches acting in concert with flying shears and the like. However, for certain products, particularly those with increased stiffness, other than minor lateral diversions of the unacceptable front and tail ends can prove to be problematical, resulting in a cobble and an interruption of the rolling process.

The principal objective of the present invention is to minimize the extent to which unacceptable front and tail ends are diverted on their way to the chopping shear, thus avoiding or at least significantly reducing the risk of cobbling.

SUMMARY OF THE INVENTION

In accordance with the present invention, hot rolled product lengths exiting from a rolling mill along a first path are directed to a first switch which acts in concert with a first shear to subdivide each product length into successive segments including a front end segment, a plurality of intermediate segments, and a tail end segment. The successive segments are alternately delivered from the first shear to one or the other of two adjacent downstream second paths. Second switches on the second paths are selectively adjustable between first positions allowing the intermediate segments to continue along the second paths to a downstream cooling bed, and second positions diverting the front or tail end segments from the second paths to third paths. A second shear operates to chop the front and tail end segments traveling along the third paths into scrap lengths that are delivered to scrap receptacles.

The second paths are arranged between the third paths to thereby minimize the deflection of the front and tail ends by the second switches.

These and other features and advantages of the present invention will now be described in greater detail with reference to the accompanying drawings; wherein:

DETAILED DESCRIPTION

Figure 1:
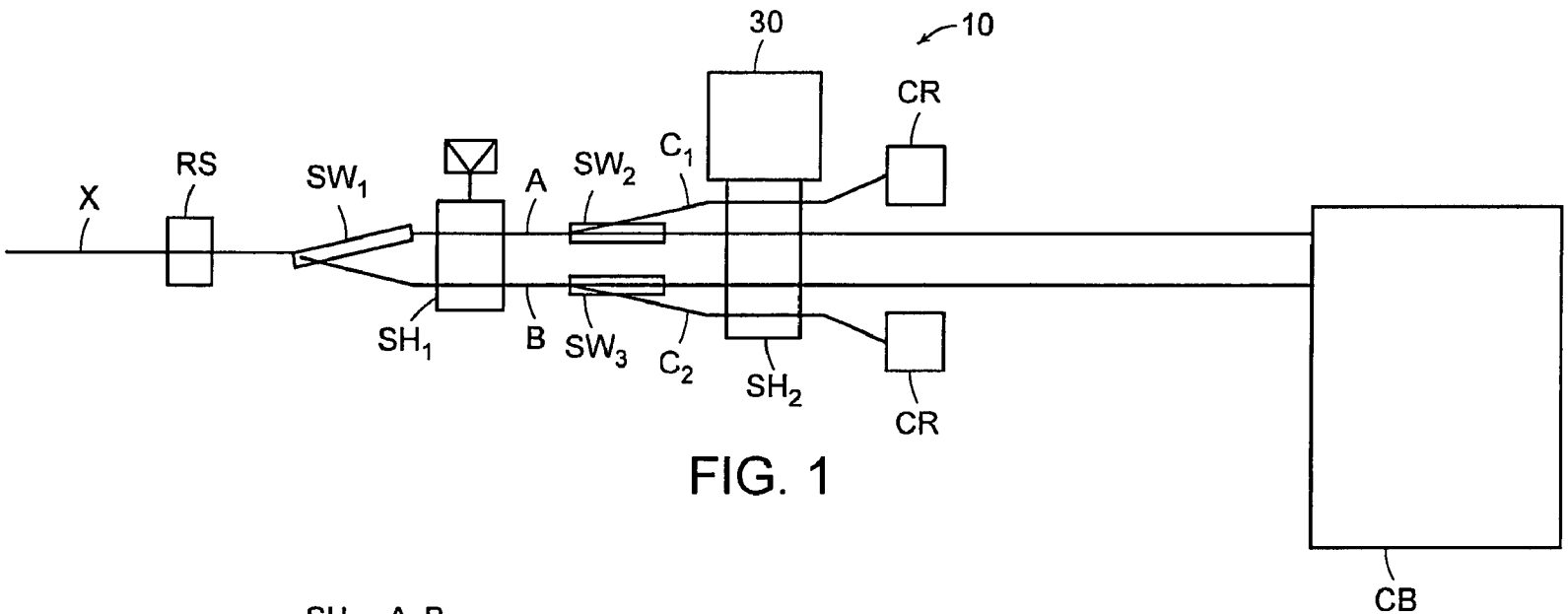
FIG. 1 is a schematic plan view of a system in accordance with the present invention.
Figure 2:
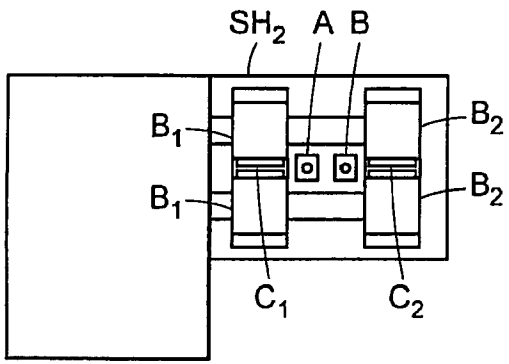
FIG. 2 is an enlarged front view of the second shear.

With reference initially to the schematic illustrations of FIGS. 1 and 2, a system in accordance with the present invention is shown at 10 at a location along the mill pass line "X" between the last roll stand RS of the mill and a cooling bed CB.

A first switch $SW_1$ operates in concert with a first shear $SH_1$ to subdivide the product lengths into successive segments, including front end segments, intermediate segments, and tail end segments. The intermediate segments comprise metallurgically acceptable customer lengths destined for delivery to the cooling bed. Depending on the type of product being produced, the front end segments may be metallurgically unacceptable due to inadequate upstream cooling. The tail end segments are often shorter than the desired customer length. The successive segments exiting from shear $SH_1$ are alternately received on adjacent downstream second paths A,B.

The subdivided segments moving along path A are directed to a second switch $SW_2$ which is adjustable to either allow the acceptable intermediate segments to continue along path A or to deflect front and tail end segments to a different path $C_1$. The subdivided segments traveling along path B are similarly directed to a third switch $SW_3$ which also is adjustable either to allow the acceptable intermediate segments to continue along path B or to deflect front and tail end segments to a different path $C_2$.

A chopping shear $SH_2$ is located downstream from the switches $SW_2$,$SW_3$. As can best be seen in FIG. 2, the shear $SH_2$ has two sets of coacting shear blades $B_1$,$B_1$ and $B_2$,$B_2$ aligned respectively on paths $C_1$, $C_2$. The paths A, B pass freely between the laterally spaced blade sets of the chopping shear. On the downstream side of shear $SH_2$, the paths $C_1$, $C_2$ lead to crop receptacles CR, and the paths A, B continue to the cooling bed CB.

Figure 3:
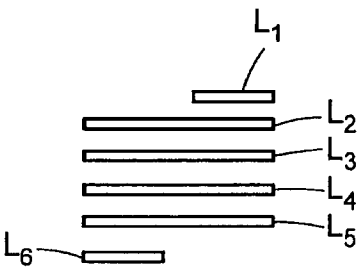
FIG. 3 is a diagrammatic representation of the successive segments produced by the first shear.

With reference to FIG. 3, in an exemplary sequence, the shears $SH_1$ would operate to subdivide billet lengths of product delivered from the last roll stand RS into a short front end segment $L_1$ of metallurgically unacceptable product, intermediate segments typically comprising acceptable customer lengths $L_2$–$L_5$, and as is more often than not, an unacceptably short tail end segment $L_6$.

The switches $SW_2$,$SW_3$ would then process these segments as shown below in Table A.

TABLE A

| Product | PATHS | | | | | Cooling Bed | Crop Receptacle |
|---|---|---|---|---|---|---|---|
| Lengths | A | B | $C_1$ | $C_2$ | Shear $SH_2$ | CB | CR |
| $L_1$ | x | | x | | x | | x |
| $L_2$ | | x | | | | x | |
| $L_3$ | x | | | | | x | |
| $L_4$ | | x | | | | x | |
| $L_5$ | x | | | | | x | |
| $L_6$ | | x | | x | x | | x |

The foregoing sequence is merely illustrative and will vary depending on the type of product being handled, the customer lengths into which it is to be subdivided, etc.

Figure 4:
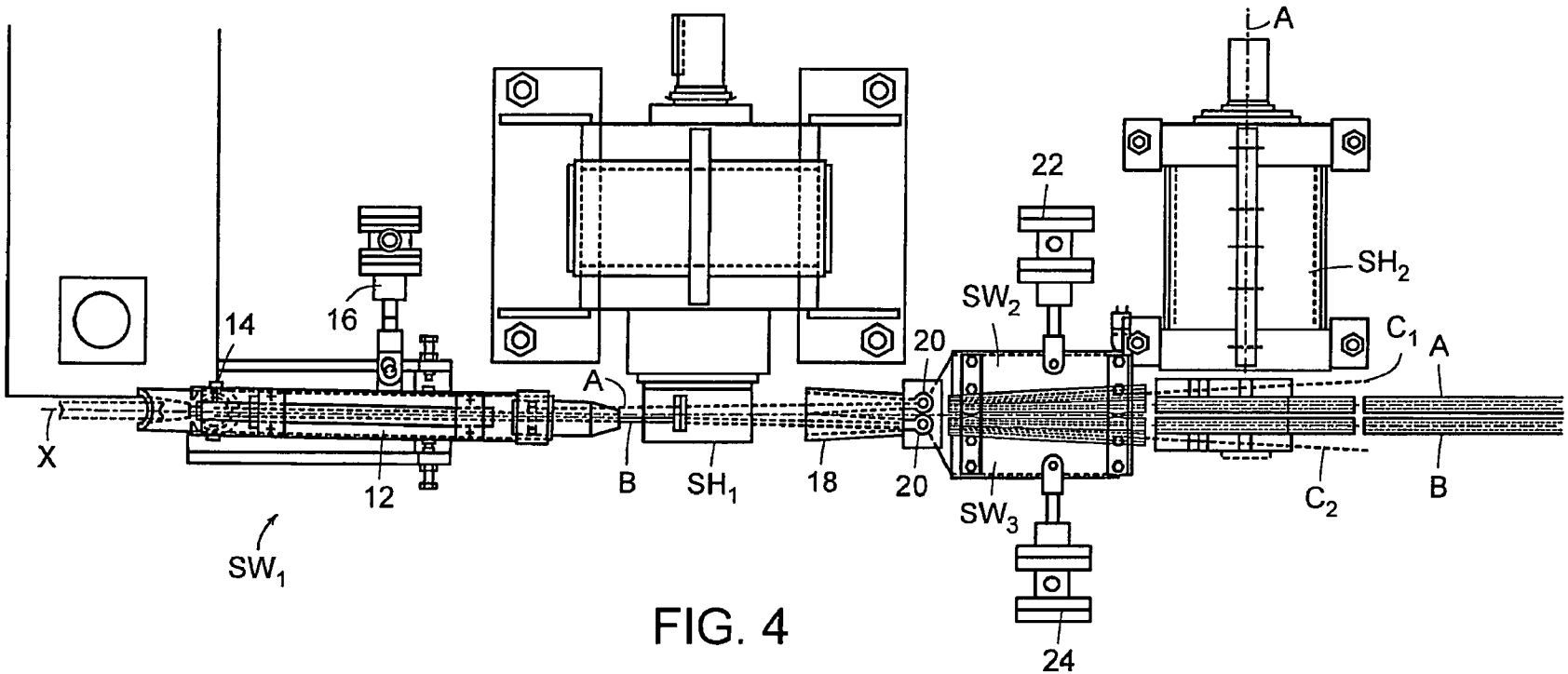
FIG. 4 is a more detailed plan view of the arrangement of switches and shears shown in FIG. 1.
Figure 5:
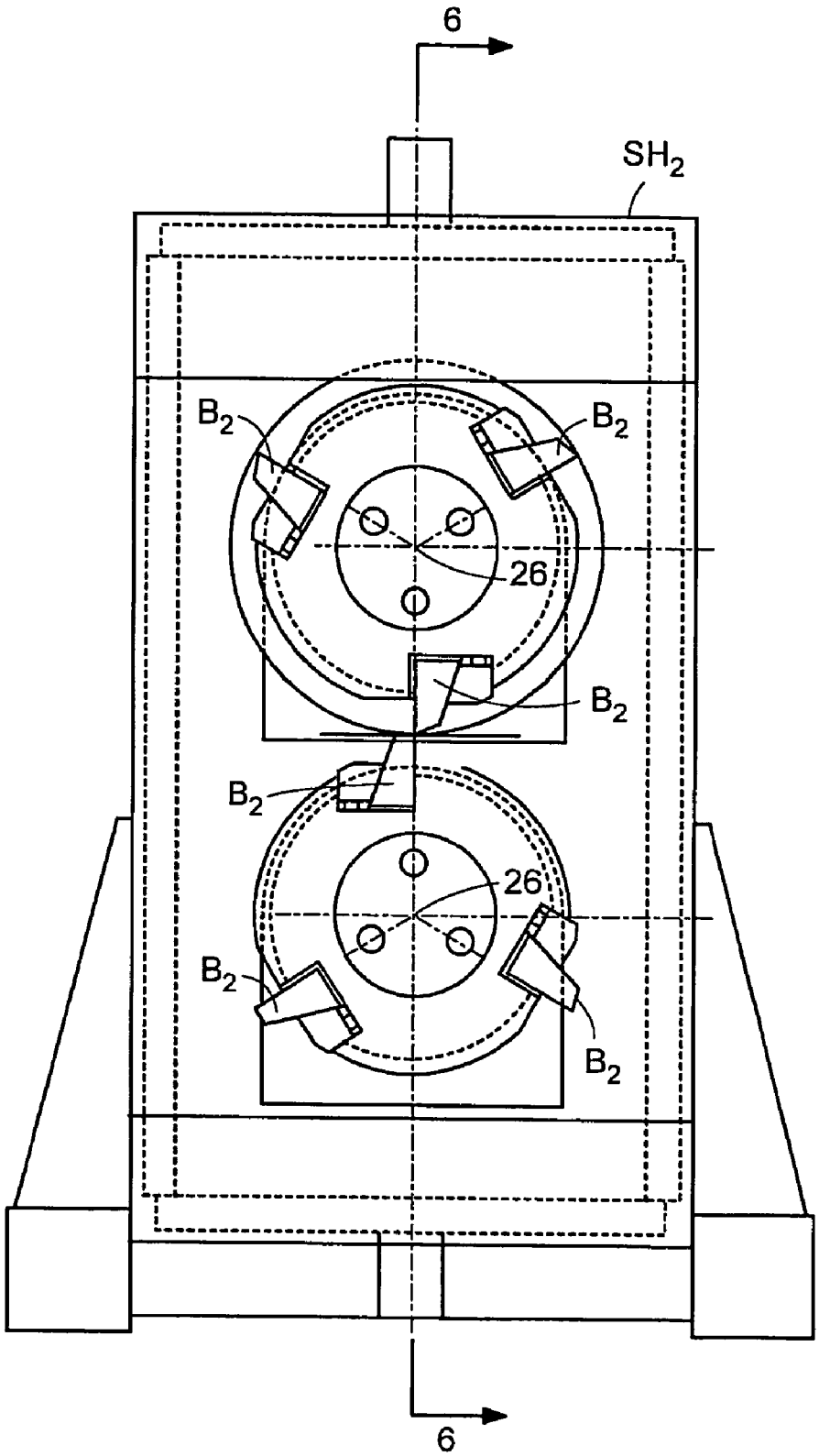
FIG. 5 is an end view of the second shear.
Figure 6:
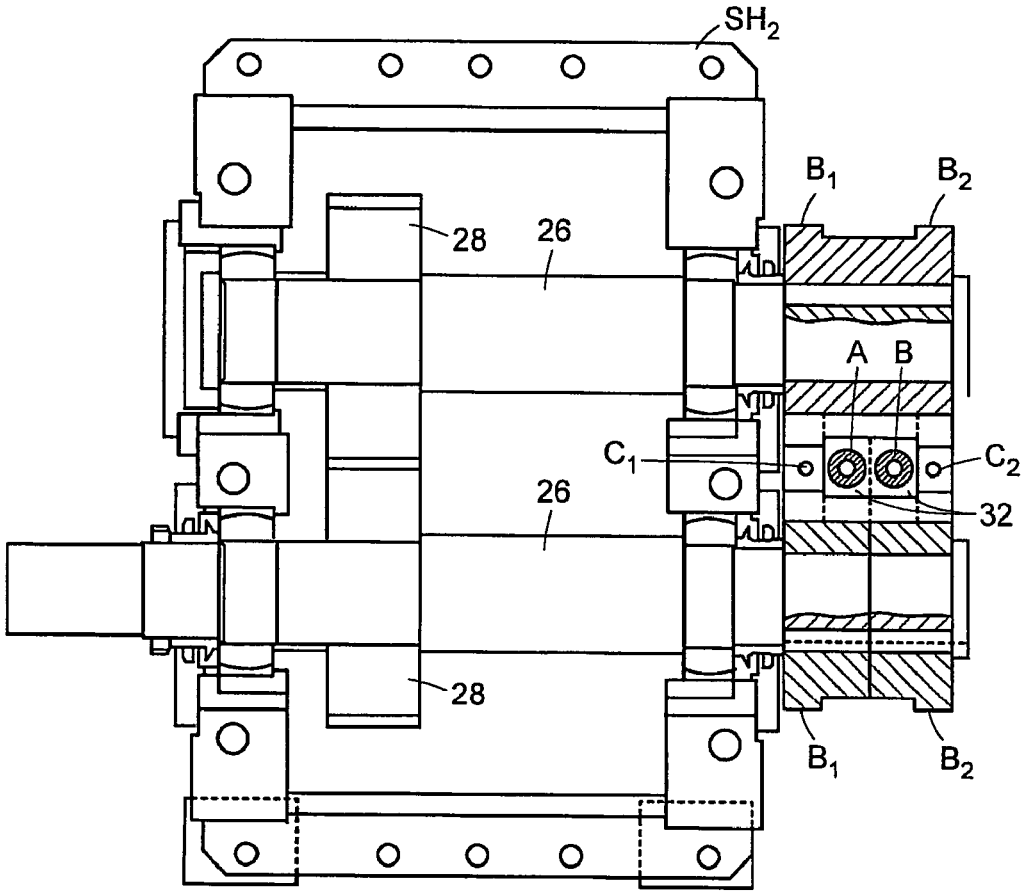
FIG. 6 is a sectional view taken along line 6—6 of FIG. 5.

A more detailed illustration of the switches and shears of the present invention can be seen by reference to FIGS. 4–6.

From FIG. 4, it will be seen that the switch SW, comprises a guide pipe 12 mounted for movement about a pivot 14, and pivotally adjustable to deliver products through shear $SH_1$ to paths A,B by a piston-cylinder unit 16. The shear $SH_1$ may be of conventional design well known to those skilled in the art.

An entry guide 18 directs segments passing along paths A,B to respective switches $SW_2$,$SW_3$, each being mounted for movement about a pivot 20. Switch $SW_2$ is adjustable by a piston-cylinder unit 22 to allow acceptable intermediate segments to continue along path A to the cooling bed, or to divert unacceptable front and tail end segments to path $C_1$. Switch $SW_3$ is similarly adjustable by a piston-cylinder unit 24 to allow acceptable intermediate segments to continue along path B, or alternatively, to divert unacceptable front and tail end segments to path $C_2$.

As can be seen from FIGS. 5 and 6, the chopping shear $SH_2$ has parallel shafts 26 carrying intermeshed gears 28. The lower shaft 26 is driven by a motor 30 (shown in FIG. 1). The externally projecting ends of the shafts carry the laterally spaced pairs of coacting shear blades $B_1$,$B_1$ and $B_2$,$B_2$ aligned respectively on the paths $C_1$,$C_2$. Guides 32 direct product segments along paths A,B between the chopping shear blades.

With the above described arrangement, the switches $SW_2$, $SW_3$ need only pivot through small angles in order to deflect product end segments from the paths A,B to their respective diversion paths $C_1$,$C_2$. In this manner, the front and tail end segments of relatively stiff products, e.g., those with larger diameters and/or lower temperatures, can be processed without the risk of cobbling.

I claim:

1. A system for subdividing hot rolled product lengths being delivered from a rolling mill along a first path, said system comprising:

a first switch acting in concert with a first shear to subdivide each product length traveling along said first path into successive segments including a front end segment, a plurality of intermediate segments, and a tail end segment, and to alternately deliver said successive segments to laterally adjacent downstream second paths located between third paths;

second switches on said second paths, said second switches being selectively adjustable between first positions allowing said intermediate segments to continue along said second paths, and second positions diverting said front and tail end segments from said second paths to said third paths; and a second shear for further subdividing the front and tail end segments moving along said third paths.

2. The system of claim 1 wherein said second paths lead to a cooling bed.

3. The system of claim 2 wherein said second shear is operable to further subdivide said front and tail end segments into scrap lengths, and wherein said third paths lead to scrap receptacles.

4. The system of claim 1 wherein said second shear comprises laterally spaced coacting pairs of shear blades mechanically connected to and driven by a common drive.

5. The system of claim 4 wherein said second paths pass between said coacting pairs of shear blades, and wherein said pairs of said coacting shear blades are arranged respectively on said third paths.

6. A method of subdividing hot rolled product lengths being delivered from a rolling mill along a first path, said method comprising:

subdividing each product length traveling along said first path into successive segments, including a front end segment, a plurality of intermediate segments and a tail end segment;

alternately delivering said successive segments to adjacent downstream second paths located between third paths;

allowing the intermediate segments to continue along said second paths, and diverting the front and tail end segments from said second paths to said third paths; and further subdividing the front and tail end segments moving along said third paths.

* * * * *